US005321857A

United States Patent [19]

Lataillade

[11] Patent Number: 5,321,857

[45] Date of Patent: Jun. 21, 1994

[54] WATER CLOSET WITH A TILTING COVER ACTING AS A BOWL

[75] Inventor: Maurice Lataillade, Tresses, France

[73] Assignee: Societe Nationale Industrielle et Aerospatiale, Paris, France

[21] Appl. No.: 750,631

[22] Filed: Aug. 27, 1991

[30] Foreign Application Priority Data

Aug. 31, 1990 [FR] France ..... 90 10993

[51] Int. Cl.[5] ..... E03D 11/13; A47K 13/16

[52] U.S. Cl. ..... 4/300; 4/319; 4/420; 4/661

[58] Field of Search ..... 4/300, 300.1, 319, 420, 4/661, 242.1, DIG. 2, DIG. 4

[56] References Cited

U.S. PATENT DOCUMENTS

| | | | |
|---|---|---|---|
| 1,017,044 | 2/1912 | Fraser | 4/329 |
| 3,094,707 | 6/1963 | Fleming | 4/319 |
| 3,638,244 | 2/1972 | Schmid et al. | 4/420 X |
| 4,720,880 | 1/1988 | Barreau | 4/661 |
| 4,744,113 | 5/1988 | Kogut | 4/661 |
| 4,949,673 | 8/1990 | Yamamoto | 4/300.1 X |

FOREIGN PATENT DOCUMENTS

| | | | |
|---|---|---|---|
| 2326497 | 12/1974 | Fed. Rep. of Germany | 4/661 |
| 2736024 | 2/1979 | Fed. Rep. of Germany | 4/319 |
| 0000527 | 2/1881 | United Kingdom | 4/420 |
| 0009628 | 8/1889 | United Kingdom | 4/420 |
| 2243165 | 10/1991 | United Kingdom | 4/319 |

*Primary Examiner*—Daniel M. Yasich
*Assistant Examiner*—W. Morris Worth
*Attorney, Agent, or Firm*—Roylance, Abrams, Berdo & Goodman

[57] ABSTRACT

A water closet with a tilting cover acting as a bowl includes one mobile portion forming a bowl for receiving solid and liquid matter and pivoting around a horizontal axis and able by rotating through approximately 180° to occupy two positions, namely one position for the bowl receiving the matter and the other position when the bowl is upturned and with one fixed portion disposed under the bowl and into which the contents of the bowl is emptied when the latter passes from the first position to the second position.

10 Claims, 3 Drawing Sheets

WATER CLOSET WITH A TILTING COVER ACTING AS A BOWL

FIELD OF THE INVENTION

The present invention concerns a water closet with a tilting cover acting as a bowl.

BACKGROUND OF THE INVENTION

The object of the invention is to provide a water system with a newly-designed and practical water flusher using less water for flushing, which is more hygienic and offers more comfort than traditional water closets with a fixed bowl.

To this effect, the purpose of the invention is to provide a water closet with a tilting cover acting as a bowl, wherein it comprises one mobile portion forming a bowl for receiving solid and liquid matter and pivoting around a horizontal axis and able by rotating through approximately 180 degrees to occupy two positions, namely one for said bowl receiving said matter and the other when the bowl is upturned and forming a cover and with one fixed portion placed under the bowl and into which the contents of the bowl is emptied when the latter passes from said first position to said second position.

According to one embodiment, said fixed portion forms a seating unit or seat defining a horizontal orifice, the mobile portion being joined onto said seat around an axis placed approximately inside the plane of said orifice in the centre of the latter and perpendicular to the sagittal plane from the person situated in the position for using the water closet.

The fixed portion is preferably equipped with means for evacuating matter and for possibly crushing or processing said matter before being removed.

According to another characteristic of the invention, the water closet is advantageously provided with a paper magazine or similar device for sheets or strips and suitable means for being deployed above the bowl when the latter is in said first position, a sheet or strip portion of said paper or other similar material to be subsequently inserted between the bottom of the bowl and the waste matter and removed by gravity at the same time as this matter.

Preferably, the water closet is provided with a water flushing system for cleaning the bowl and constituted by a washing ramp placed either on the bowl or on the fixed portion of the water closet, this ramp operating when the bowl moves to reach said second position.

The movement of the bowl is effected either manually or controlled by any suitable mechanical device.

BRIEF DESCRIPTION OF THE DRAWINGS

Other characteristics and advantages shall appear more readily from an embodiment of a water closet conforming to the invention, this description being given solely by way of example accompanied by the drawings on which.

DETAILED DESCRIPTION OF THE PREFERRED EMBODIMENTS

Figure 1:
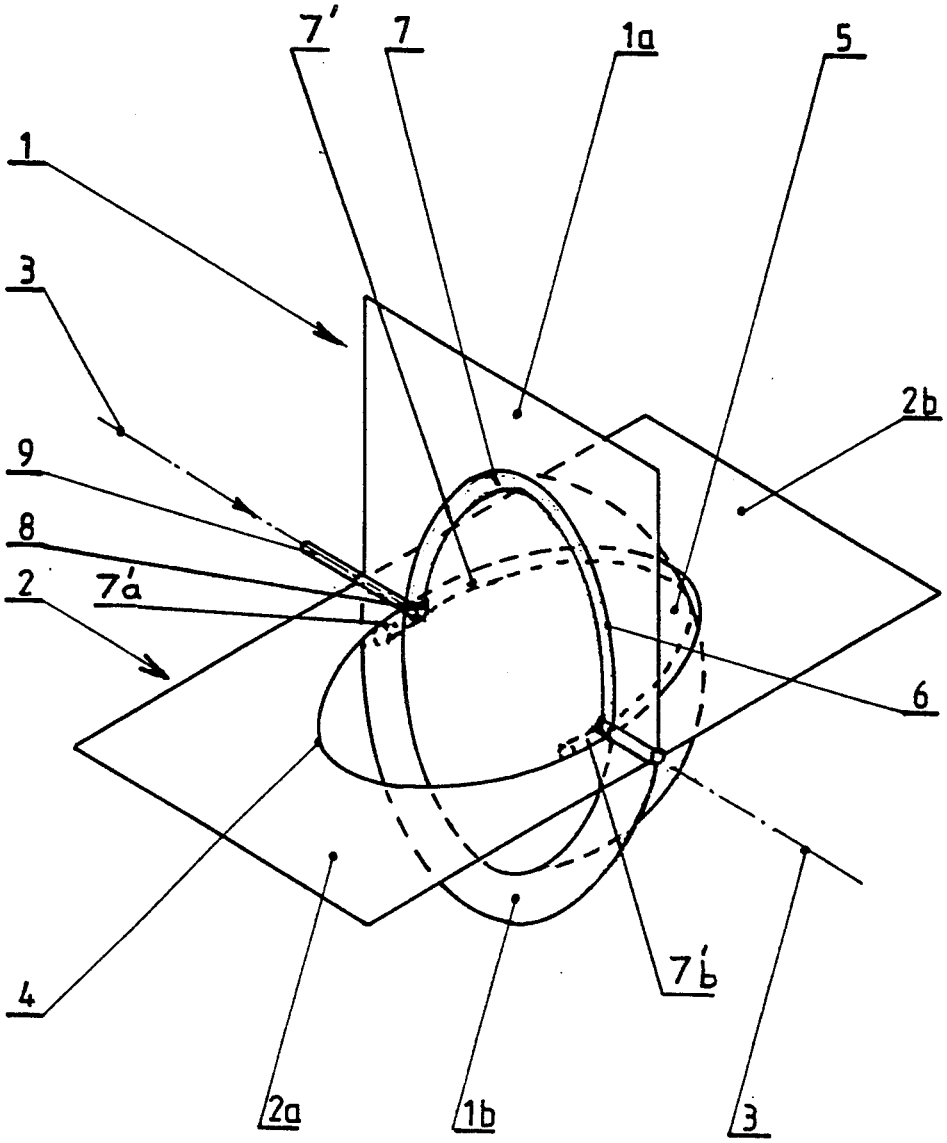
FIG. 1 is a perspective diagrammatical view showing the principle of the water closet of the invention.

FIG. 1 diagrammatically shows the principle of the water closet of the invention. Symbolically shown at 1 is the mobile portion of the device and at 2 the fixed portion on which is articulated around a horizontal axis or hinge pin 3 said mobile portion 1.

The fixed portion 2 has the shape of a plane rectangular plate pierced by an elliptical-shaped orifice 4, the hinge pin 3 of the mobile portion 1 being placed roughly along the small axis of the ellipse 4 perpendicular to the sagittal plane of the person seated in the water closet use position, in other words seated on preceding half portion 2*a* of the portion 2 forming the seating unit or seat.

The mobile portion 1 comprises a bowl 5 with a semi-ellipsoid shape closed bottom and a plane edge encirling the bowl 5 and defining on one side of the hinge pin 3 a portion 1*a* whose shape corresponds to said portion 2*a* and, on the other side of the hinge pin 3, an elliptical flange 1*b*.

The bowl edge 6 corresponds to the edge of the orifice 4.

The portion 1 is made to pivot over the portion 2 at the height of the hinge pin with the aid of any suitable device.

The bowl 5 is advantageously provided with an under pressure water flushing system constituted, for example, by an incurved sprinkling pipe 7 running along the back edge 6 (in the bowl use position) and provided with holes directed towards the wall of the bowl.

One extremity of the pipe 7 is connected by a revolving joint 8 to an under pressure water feed pipe 9 coaxial to the hinge pin 3.

The mobile portion 1 may occupy two positions, the first known as the position for using the bowl 5, the portion 1*a* being moved against the portion 2*b* and the portion 1*b* against the portion 2*a*, and the other position, known as the bowl overturning position, (periods when water closet is not used) for which the portion 1*a* is moved against the portion 2*a* and the portion 1*b* against the portion 2*b*. The bowl moved from one position to the next by rotating by about 180 degrees.

Advantageously, gaskets of suitable shapes and dimensions are provided between the portions in contact in the two above-mentioned positions, in other words around the ellipses 4 and 6 on one/or the other face of the portions concerned (1*a*, 1*b*; 2*a*, 2*b*).

Figure 2:
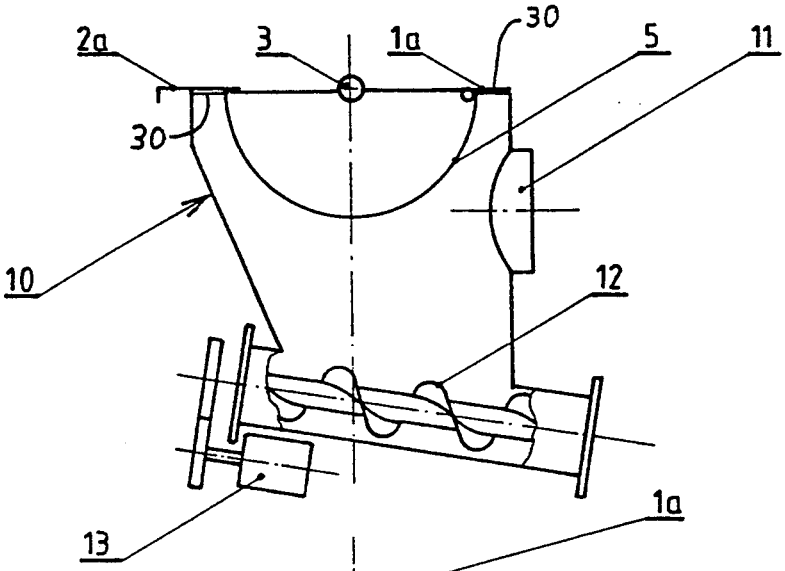
FIG. 2 is a lateral front view of a water closet of the invention in the bowl use position.
Figure 3:
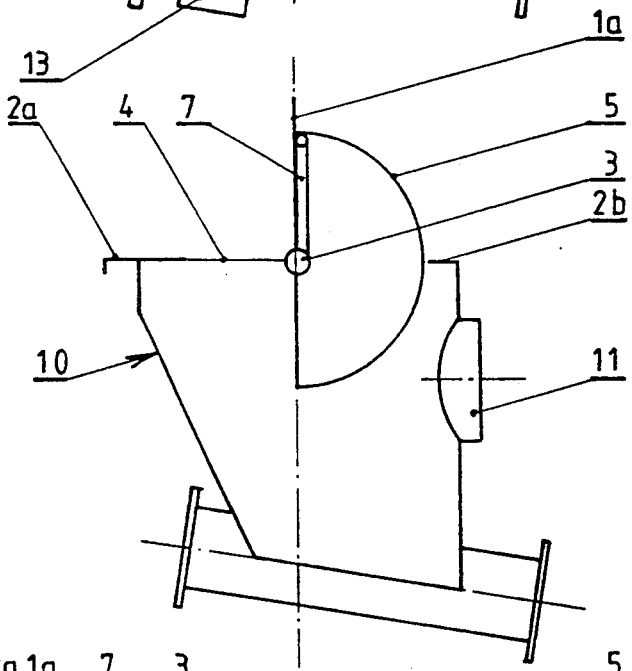
FIG. 3 shows the device of FIG. 2 with the bowl in the process of overturning.
Figure 4:
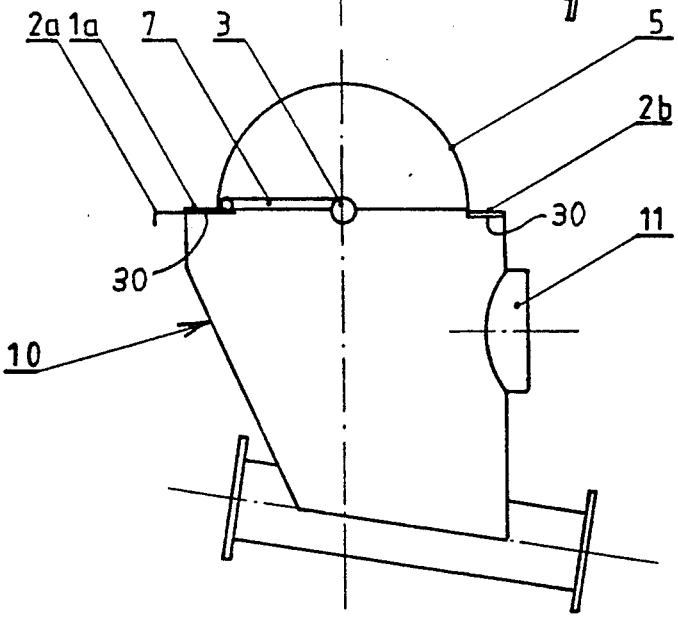
FIG. 4 shows the device with the bowl fully upturned.

FIGS. 2 to 4 diagrammatically show a water closet using the principle shown in FIG. 1. The elements of this water closet similar to the corresponding portions of FIG. 1 bear the same numerical references.

The bowl 5 is placed above a water closet 10 whose upper portion defines the fixed portions 2*a*, 2*b* supporting the bowl.

The body 10 is equipped at the rear with an inspection flap 11 and at the lower portion with a crushing-extraction screw 12 driven by a back-geared motor 13.

The device shown on FIGS. 2 to 4 may be advantageously provided with means for placing the paper protector on the bottom of the bowl 5 when the latter tilts so as to have it move from its idle position (FIG. 4), when the bowl is upturned above the orifice 4 delimited in the fixed portion 2a, 2b, into its use position (FIG. 2).

Figure 5:
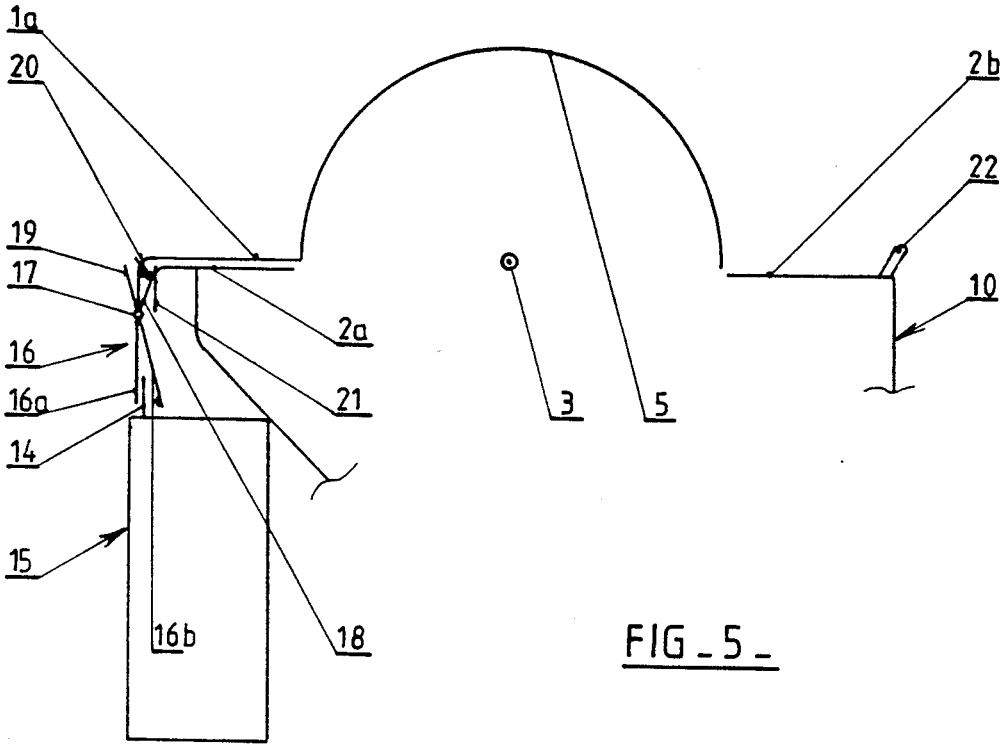
FIG. 5 shows suitable means for placing a paper holder over the bowl when the latter is in its use position.
Figure 6:
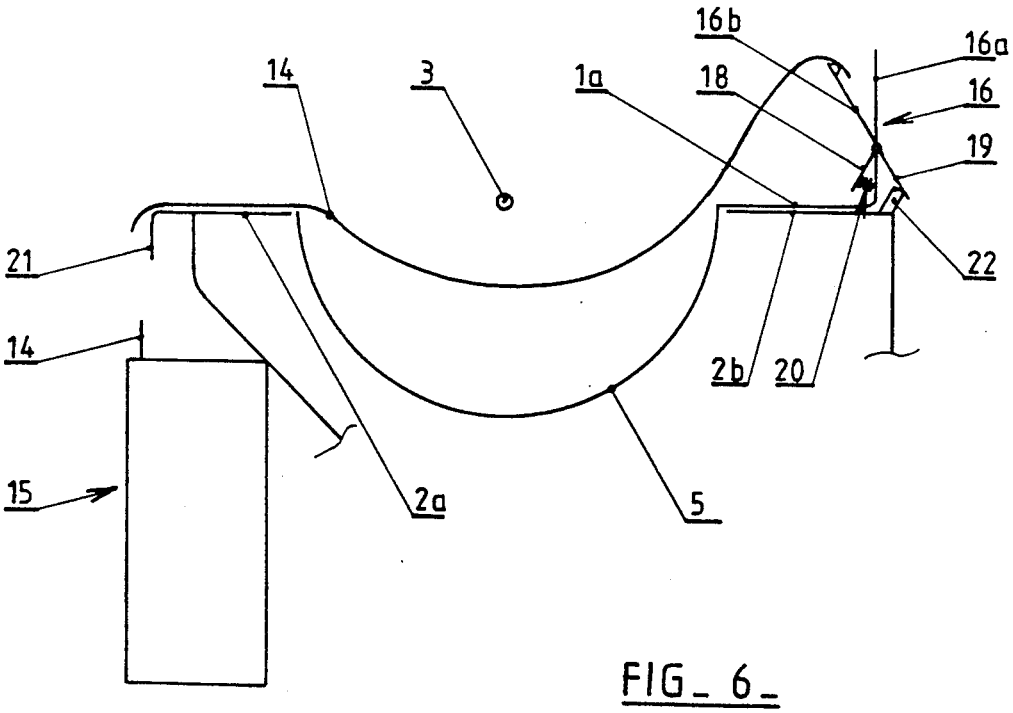
FIG. 6 shows the device of FIG. 5 in the bowl use position.

FIGS. 5 and 6 show an embodiment of such means able to unfold a suitable, such as rectangular, sheet of paper 14 above the bowl. The sheets 14 are stored in a magazine symbolized at 15 and intended to provide the sheets 14 one at a time by making one extremity of the sheet project over the upper portion of the magazine. Such a principle for distributing sheets one at a time is well known and does not need to be described in full. When a sheet 14 is pulled out from the magazine 15, the next sheet automatically takes a stand-by position with its projecting extremity orientated upwards.

The projecting extremity of the sheet 14 in the magazine is picked up by a squeezing device 16 integral with the portion 1a of the bowl when the latter is in upturned position (FIG. 5). More specifically, said squeezing device 16 includes a fixed handle 16a constituted by an edge at 90 degrees from said portion 1a and a mobile handle 16b joined at 17 onto the handle 16a and extend beyond the hinge pin 17 by a first lever 18 for opening the squeezing device 16 and by a second opening lever 19, the pliers 16 being in the normal closing position under the action of a permanent return spring 20.

When the bowl 5 reaches the end of tilting travel (FIG. 5), the lever 18 comes into contact with the edge 21 of the portion 2a and moves the handle 16b from the handle 16a, thus allowing the squeezing device 16 to be engaged astride on the section of the sheet 14 of the magazine without picking up the latter. The device remains in this position through the period when the water closet is not used.

When the bowl opens, as soon as the portion 1a rises, the squeezing device 16 closes onto the sheet 14, moves it and then extracts it completely from the magazine 15 and unfolds it above the bowl (FIG. 6).

At the end of travel for opening the bowl 5, the lever 19 comes into contact with a fixed stop 22 integral with the portion 2b and opens the squeezing device 16, thus releasing the sheet 14. The squeezing device 16 shall only close when the portion 1a raises so as to place the bowl 5 back in the water closet covering position.

It is possible to provide solely one squeezing device 16 sufficiently wide or two identical squeezing devices spaced from each other. The lever(s) 19 projecting outwardly are disposed laterally to the portion 1a or passing through a window fitted to this effect in the wall of the portion 1a.

Of course, other means may be used to unfold the paper, regardless of whether this involves one single sheet or lengths taken from a strip or roll of paper.

The width of the paper is sufficient to form a screen between the bowl 5 and the excrement, which limits excrement marks on the bowl and the amount of flushing water.

When the bowl 5 has returned to its upturned position, its tilting will cause the fall of both the unit formed by the paper lying on the bottom and the matter already deposited on the paper. This unit is dealt with by the crushing-evacuation system 12–13 and, at the end of the bowl tilting operation (FIG. 4), the flushing system 7 is put into operation so as to clean the side of the bowl by eleminating all stained marks, in particular liquid stains due to the presence of the protective paper.

Putting the system 7 into operation for a predetermined time may be advantageously triggered automatically, for example, by an end-of-travel detector detecting upturning of the bowl 5.

If said paper holder is a roller, paper-tearing starts points are provided from place to place in the paper so as to allow for subsequent easy separation from the paper portion placed above the bowl upon opening of the water closet. A paper sectioning device may also be provided so as to separate at the end of the opening of the bowl 5 the paper portion unfolded above the bowl from the rest of the roller.

The bowl 5 may function manually or mechanically by means of suitable mechanical tilting means controlled by the user or automatically from a detector detecting the presence of a person in the room where the water closet is installed.

Gaskets 30, as graphically illustrated in FIGS. 2 and 4, are provided between the mobile portions (1a, 1b) and fixed portions (2a, 2b) seal joints between the mobile and fixed portions to limit to the maximum the spreading of odours from inside the body (10), not solely when the water closet is not used (bowl 5 upturned, FIG. 5) but when said water closet is in use (FIG. 2).

Finally, the invention is not limited to the embodiment shown and described above but, on the other hand, covers all possible variants, in particular as regards the shapes and dimensions of the bowl 5 and the marginal portions surrounding it, the shapes and dimensions of the fixed portions 2a, 2b on both sides of the hinge pin 3 of the bowl, the type and disposition of the gaskets between the two fixed 2 and mobile 1 portions of the water closet, flushing means for the bowl 5, as well as any possible means for deploying a paper holder or any similar device inside the bowl when the latter is in use.

Thus, the flushing means for the bowl 5, instead of being constituted by a ramp 7 integral with the bowl, may be constituted by a ramp 7' (FIG. 1) of similar design integral with the fixed external portion 2a and disposed near the plane of the orifice 4 opposite and close to the bottom of the bowl. To this effect, solely one and/or the other extremity 7'a, 7'b are fixed to said portion 2a, water supply being provided by one or the other extremity from the pipe 9.

When the bowl 5 is in the process of overturning, the fixed ramp 7' sweeps the entire bottom of the bowl. This type of embodiment does not require a rotating joint 8.

What is claimed is:

1. A water closet with a tilting cover acting as a bowl, comprising:

a mobile portion forming a bowl for receiving solid and liquid matter;

a fixed portion disposed under said bowl for receiving contents of said bowl;

pivot means for pivotally mounting said mobile portion on said fixed portion for rotation of said mobile portion, through an arc of about 180 degrees about a horizontal pivot pin, between a first position in which said bowl is oriented to be open generally upwardly to receive the matter and a second position in which said bowl is oriented to open generally downwardly for emptying matter from said bowl into said fixed portion; and magazine means, located adjacent said mobile portion, for deploying protective material over said bowl when said mobile portion is in said first position, said protective material being inserted between a bottom of said bowl and the matter and being evacuated by gravity simultaneously with the matter, said magazine means including a squeezing means for picking up a section of said protective material between relatively movable members on said mobile portion and a fixed stop engaging at least one of said movable members in said second position of mobile portion to release said protective material from said squeezing means.

2. A water closet according to claim 1 wherein said fixed portion comprises a seating means for a person with an orifice in a horizontal plane; and said pivot pin is located approximately in said horizontal plane and in a central zone of said orifice, and is generally perpendicular to a sagittal plane of the person seated on said seating means with said mobile portion in said first position.

3. A water closet according to claim 2 wherein a receiving body is integral with said fixed portion and is disposed under said orifice in said fixed portion; and said receiving body includes means for evacuating the matter.

4. A water closet according to claim 1 wherein a receiving body is integral with said fixed portion and is disposed under said orifice in said fixed portion; and said receiving body includes means for evacuating the matter.

5. A water closet according to claim 1 wherein said protective material is in strips.

6. A water closet according to claim 1 wherein said protective material is in sheets.

7. A water closet according to claim 1 wherein said protective material is paper.

8. A water closet according to claim 1 wherein gaskets are mounted on said mobile and fixed portions for sealing joints therebetween.

9. A water closet with a tilting cover acting as a bowl, comprising:

a mobile portion forming a bowl for receiving solid and liquid matter;

a fixed portion disposed under said bowl for receiving contents of said bowl;

pivot means for pivotally mounting said mobile portion on said fixed portion for rotation of said mobile portion, through an arc of about 180 degrees about a horizontal pivot pin, between a first position in which said bowl is oriented to be open generally upwardly to receive the matter and a second position in which said bowl is oriented to open generally downwardly for emptying matter from said bowl into said fixed portion;

magazine means, located adjacent said mobile portion, for deploying protective material over said bowl when said mobile portion is in said first position, said protective material being inserted between a bottom of said bowl and the matter and being evacuated by gravity simultaneously with the matter, said magazine means including a squeezing means for picking up a section of said protective material between relatively movable members on said mobile portion and a fixed stop engaging at least one of said movable members in said second position of mobile portion to release said protective material from said squeezing means; and flushing means, coupled to said bowl, for cleaning said bowl, said flushing means including a sprinkling pipe mounted along a portion of an upper edge of said bowl, and a rotating joint for coupling said pipe to a source of water pressure.

10. A water closet with a tilting cover acting as a bowl, comprising:

a mobile portion forming a bowl for receiving solid and liquid matter;

a fixed portion disposed under said bowl for receiving contents of said bowl;

pivot means for pivotally mounting said mobile portion on said fixed portion for rotation of said mobile portion, through an arc of about 180 degrees about a horizontal pivot pin, between a first position in which said bowl is oriented to be open generally upwardly to receive the matter and a second position in which said bowl is oriented to open generally downwardly for emptying matter from said bowl into said fixed portion;

magazine means, located adjacent said mobile portion, for deploying protective material over said bowl when said mobile portion is in said first position, said protective material being inserted between a bottom of said bowl and the matter and being evacuated by gravity simultaneously with the matter, said magazine means including a squeezing means for picking up a section of said protective material between relatively movable members on said mobile portion and a fixed stop engaging at lest one of said movable members in said second position of mobile portion to release aid protective material from said squeezing means; and flushing means, coupled to said bowl, for cleaning said bowl, said flushing means including a sprinkling pipe bent inwardly to correspond to said bowl and mounted on said fixed portion adjacent said orifice for cleaning the bowl while said mobile portion is rotating, and coupling means for connecting said pipe to a source of water pressure.

* * * * *

UNITED STATES PATENT AND TRADEMARK OFFICE

CERTIFICATE OF CORRECTION

PATENT NO. : 5,321,857
DATED : June 21, 1994
INVENTOR(S) : Maurice Lataillade

It is certified that error appears in the above-indentified patent and that said Letters Patent is hereby corrected as shown below:

On the title page,

" [73] Assignee: Soiete Nationale Industrielle et Aerospatiale, Paris, France"

should read

-- [73] Assignee: Aerospatiale Societe Nationale Industrielle, Paris, France --.

Signed and Sealed this

Eighth Day of November, 1994

*Attest:*

Bruce Lehman

BRUCE LEHMAN

*Attesting Officer*

*Commissioner of Patents and Trademarks*